US005094415A

United States Patent [19]

Revette et al.

[11] Patent Number: 5,094,415

[45] Date of Patent: Mar. 10, 1992

[54] CONTAINER SUPPORT APPARATUS

[76] Inventors: Barbara L. Revette, 52 Camden St., Milford, Conn. 06460; Rita J. Falco, 34 Sagamore Dr., Seymour, Conn. 06483

[21] Appl. No.: 634,750

[22] Filed: Dec. 24, 1990

[51] Int. Cl.[5] ..... A47G 29/00

[52] U.S. Cl. ..... 248/133; 248/154

[58] Field of Search ..... 248/133, 131, 137, 146, 248/152, 311.2, 314, 102, 105, 106, 154

[56] References Cited

U.S. PATENT DOCUMENTS

| | | | |
|---|---|---|---|
| 703,802 | 7/1902 | Ludin | 248/146 |
| 1,609,246 | 11/1926 | Hamburger | 248/137 |
| 2,267,113 | 12/1941 | Kyprie | 248/102 |
| 2,361,303 | 10/1944 | MacDonell | 248/133 |
| 2,654,556 | 10/1953 | Lathrop | 248/105 |
| 2,893,672 | 7/1969 | Vardan | 248/102 |
| 3,545,709 | 12/1970 | Harvey | 248/146 |
| 4,359,786 | 11/1982 | Rosberg | 248/146 |

*Primary Examiner*—David M. Purol

*Assistant Examiner*—Robert A. Olson

*Attorney, Agent, or Firm*—Leon Gilden

[57] ABSTRACT

An apparatus is provided for mounting a container, and particularly a container of baby food for convenience of dispensing contents of the container. The organization includes a suction cup support base, with a support leg directed upwardly therefrom, with a plurality of "U" shaped frameworks arranged at 90 degrees relative to one another, each mounted orthogonally and in alignment relative to the support leg. The "U" shape legs include a plurality of semi-cylindrical support rings at an upper terminal end of one of said "U" shaped frames, with the semi-cylindrical support rings including spring connections therebetween to define a cylindrical configuration that may be expanded for accepting a container therewithin. A modification of the invention includes a suction cup support mounted to an intersection defined by the "U" shaped frames in alignment with the support leg, and further including a utensil support mounted to the support leg.

5 Claims, 4 Drawing Sheets

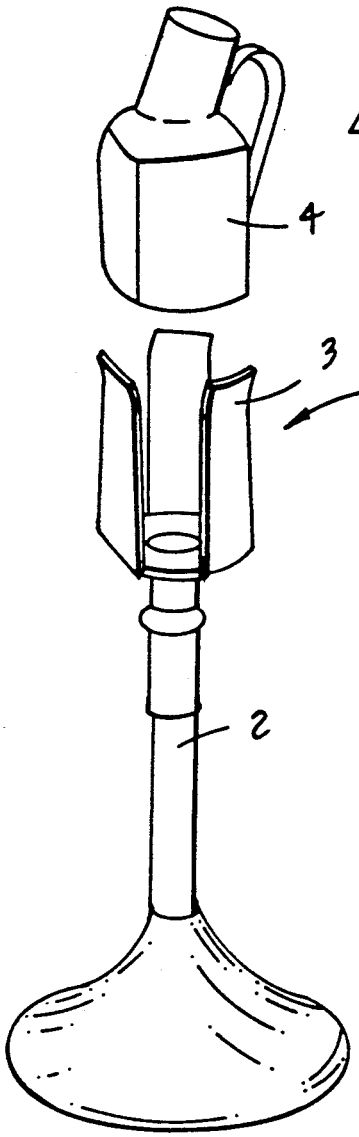
Fig 1
PRIOR ART
Fig 2
PRIOR ART
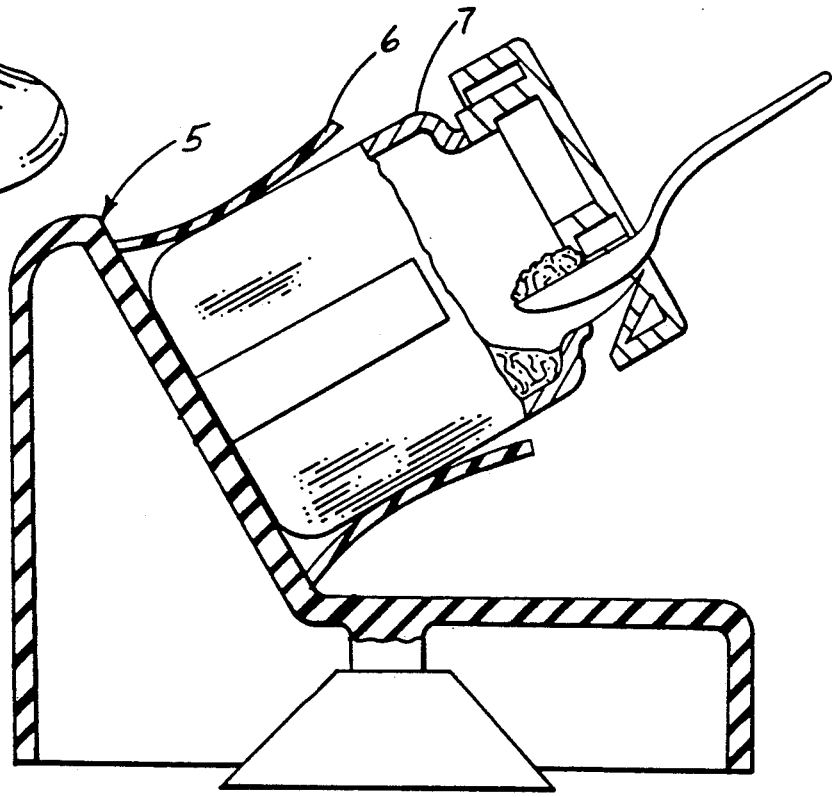

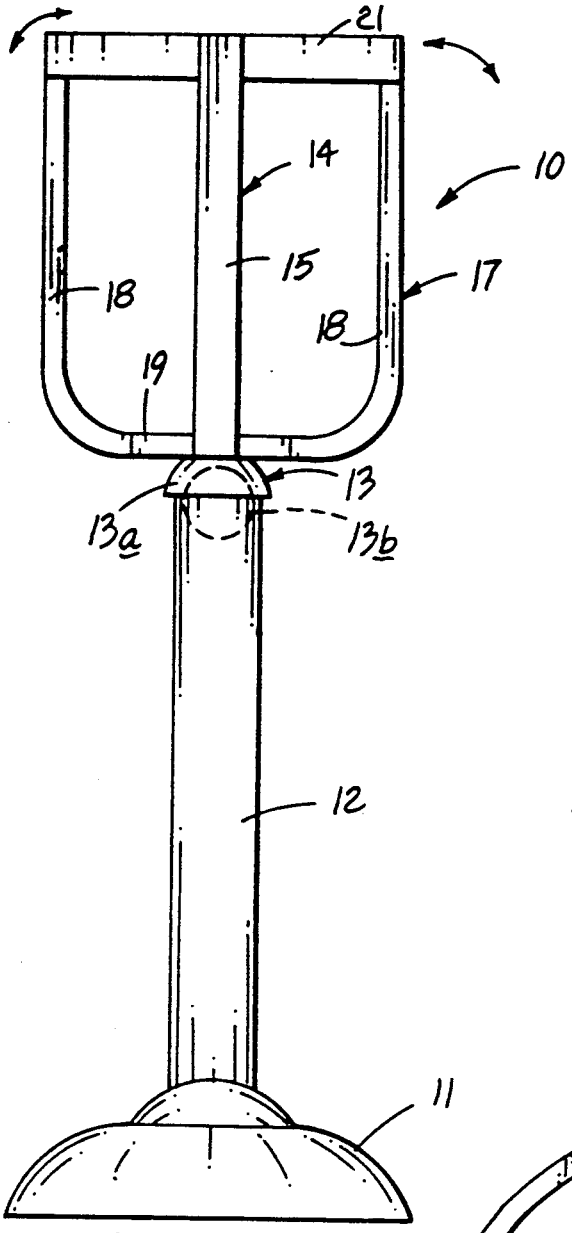
Fig 3
Fig 4
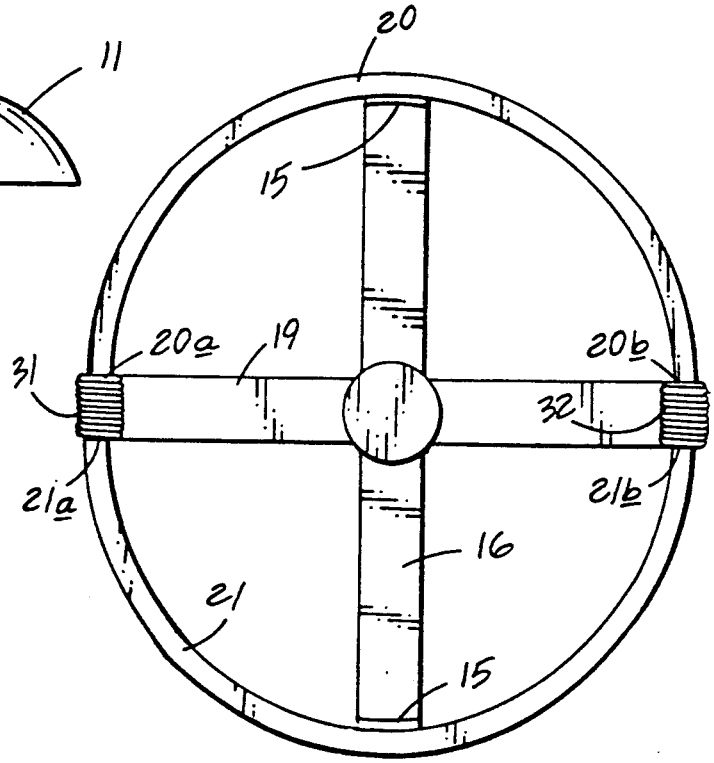

FIG 5
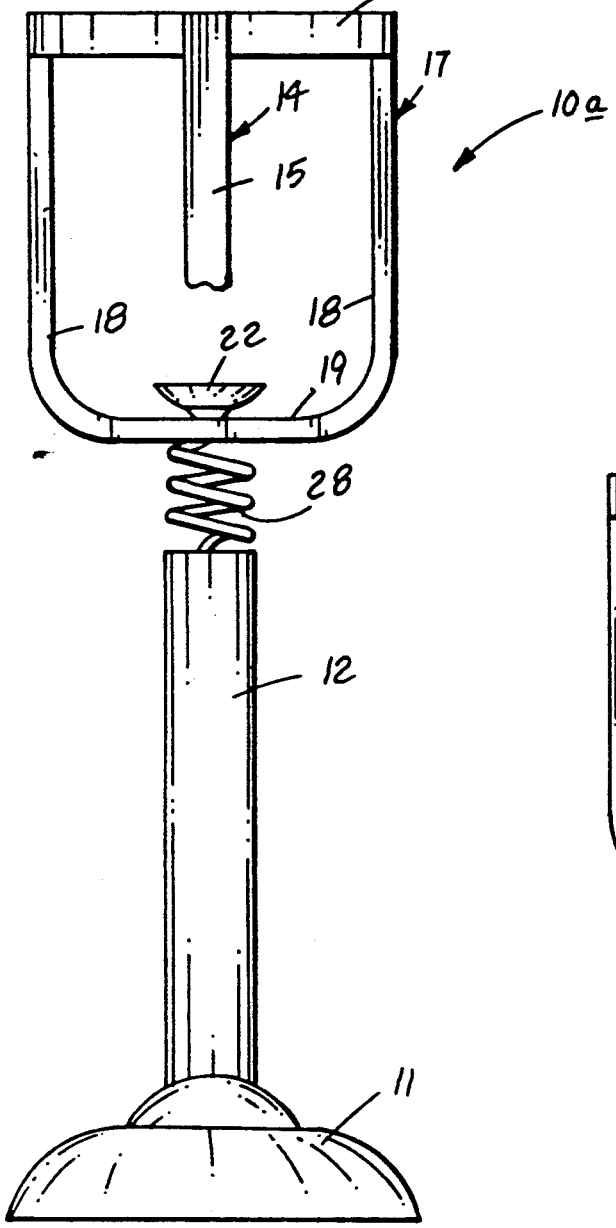
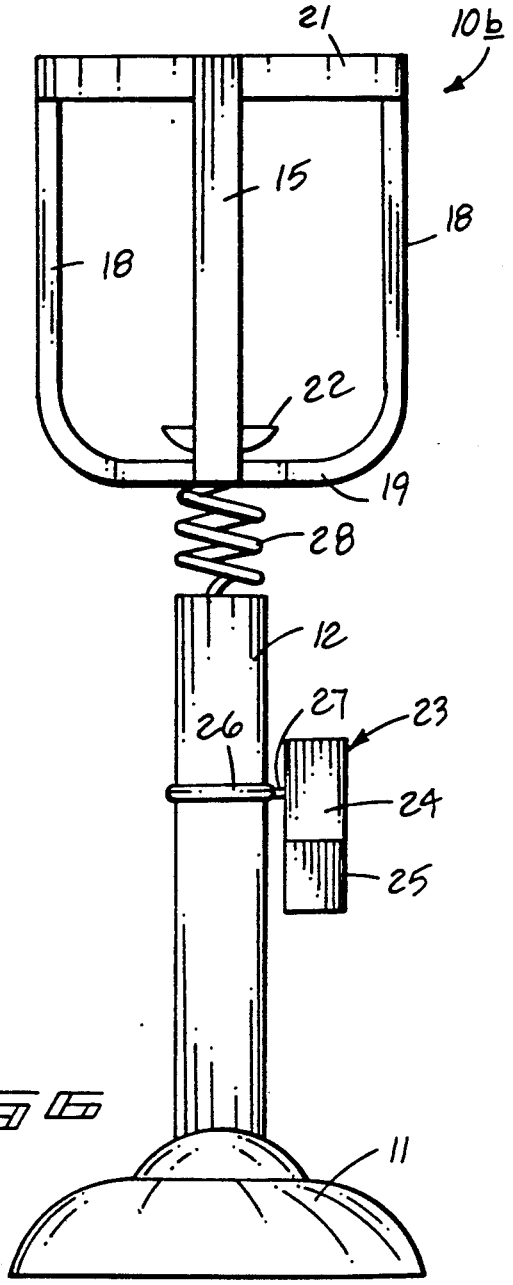
FIG 6

Fig 7
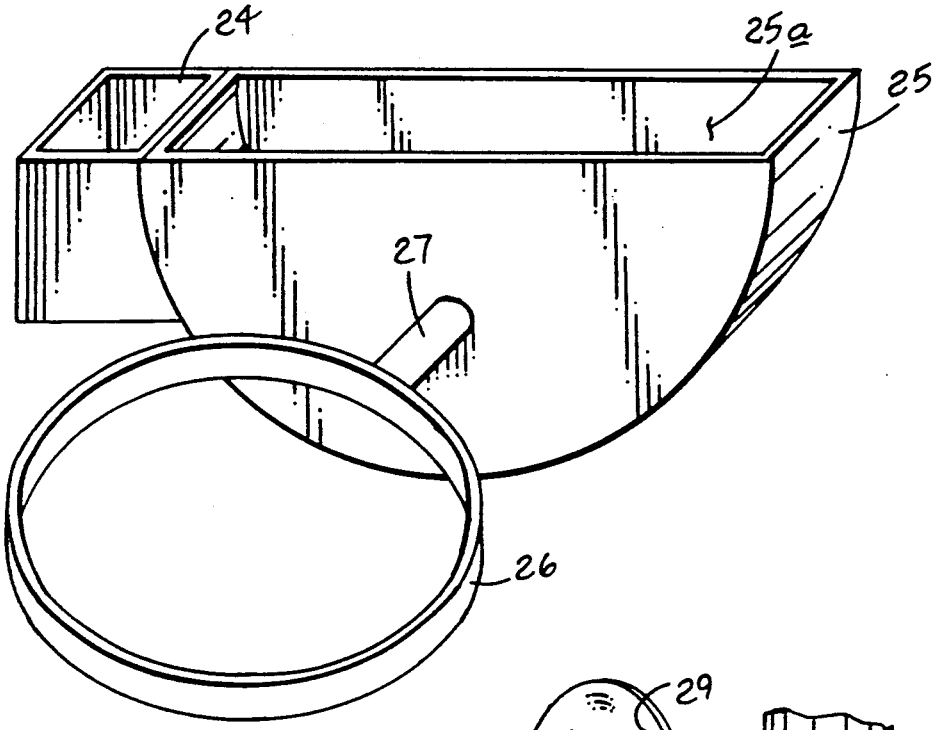
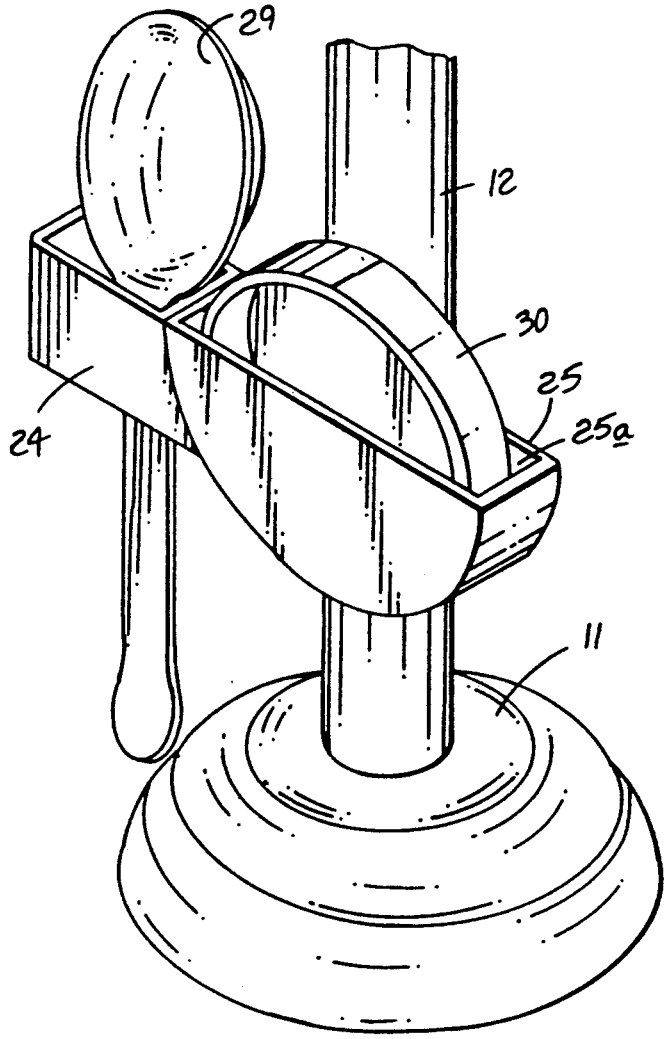
Fig 8

CONTAINER SUPPORT APPARATUS

BACKGROUND OF THE INVENTION

1. Field of the Invention

The field of invention relates to support apparatus, and more particularly pertains to a new and improved container support apparatus wherein the same provides a mounting for a container for dispensing of the contents, with suction cups to enhance stabilization of the apparatus.

2. Description of the Prior Art

In dispensing of baby food from a container, it is frequently desirable and frequently necessary to provide securement for the container to limit one-handed delivery of baby food from the container for purposes of convenience and accommodating a child. Examples of prior art container support structure may be found in U.S. Pat. No. 4,223,859 to Erickson wherein a pail is mounted to an upper terminal end of a support rod.

U.S. Pat. No. 3,836,056 to Pehr sets forth a dispensing container molded into unitary configuration with support structure.

U.S. Pat. No. 4,693,440 to Lalonde sets forth a refreshment cup holder utilizing pivoted jaws for containing the cup therewithin.

U.S. Pat. No. 4,001,444 to Clarke sets forth a baby food container support structure utilizing plural pairs of spring-biased legs that are fixedly mounted to and integral with a support stand for securing a baby food container therewithin.

U.S. Pat. No. 4,359,786 to Rosberg, et al. sets forth a container support accessory wherein a vertical support leg utilizes a trio of spring-biased fingers to mount the container therewithin.

As such, it may be appreciated that there continues to be a need for a new and improved container support apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of container support apparatus now present in the prior art, the present invention provides a container support apparatus wherein the same provides an underlying and encircling spring-biased support for mounting and providing limited pivotment for a baby food container. As such, the general purpose of the present invention, which will be described subsequently in greater detail, is to provide a new and improved container support apparatus which has all the advantages of the prior art container support apparatus and none of the disadvantages.

To attain this, the present invention provides an apparatus for mounting a container, and particularly a container of baby food for convenience of dispensing contents of the container. The organization includes a suction cup support base, with a support leg directed upwardly therefrom, with a plurality of "U" shaped frameworks arranged at 90 degrees relative to one another, each mounted orthogonally and in alignment relative to the support leg. The "U" shaped legs include a plurality of semi-cylindrical support rings at an upper terminal end of one of said "U" shaped frames, with the semi-cylindrical support rings including spring connections therebetween to define a cylindrical configuration that may be expanded for accepting a container therewithin. A modification of the invention includes a suction cup support mounted to an intersection defined by the "U" shaped frames in alignment with the support leg, and further including a utensil support mounted to the suppor leg.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container support apparatus which has all the advantages of the prior art container support apparatus and none of the disadvantages.

It is another object of the present invention to provide a new and improved container support apparatus which may be easily and efficiently manufactured and marketed.

It is a further object of the present invention to provide a new and improved container support apparatus which is of a durable and reliable construction.

An even further object of the present invention is to provide a new and improved container support apparatus which is susceptible of a low cost of manufacture with regard to both materials and labor, and which accordingly is then susceptible of low prices of sale to the consuming public, thereby making such container support apparatus economically available to the buying public.

Still yet another object of the present invention is to provide a new and improved container support apparatus which provides in the apparatuses and methods of the prior art some of the advantages thereof, while simultaneously overcoming some of the disadvantages normally associated therewith.

Still another object of the present invention is to provide a new and improved container support apparatus wherein the same is conveniently and readily mounted relative to a feeding station and permits convenience of securing a baby food containing therewithin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art container support apparatus.

FIG. 2 is an orthographic side view, partially in section of a further example of a prior art container support apparatus.

FIG. 3 is an orthographic side view, taken in elevation, of the instant invention.

FIG. 4 is an orthographic top view of the instant invention.

FIG. 5 is an orthographic side view, partially in section, of a modified container support apparatus of the instant invention.

FIG. 6 is an orthographic side view, taken in elevation, of a further modified container support apparatus of the instant invention.

FIG. 7 is an isometric illustration of the utensil holder utilized by the further modified container support apparatus as set forth in FIG. 6.

FIG. 8 is an isometric illustration of the utensil holder in association with the support leg of the instant invention.

DESCRIPTION OF THE PREFERRED EMBODIMENT

With reference now to the drawings, and in particular to FIGS. 1 to 8 thereof, a new and improved container support apparatus embodying the principles and concepts of the present invention and generally designated by the reference numerals 10, 10*a*, and 10*b* will be described.

FIG. 1 illustrates a prior art container support apparatus 1, wherein the support leg 2 utilizes a trio of spring-biased fingers 3 to mount a continer 4 therewithin, in a manner as set forth in U.S. Pat. No. 4,359,786. FIG. 2 illustrates a further prior art container support apparatus 5 wherein a jar of baby food 7 is mounted within encircling spring-biased fingers 6 that are integrally secured to an inclined support that in turn are fixedly mounted to a base by a suction cup, in a manner as presented in U.S. Pat. No. 4,001,444.

More specifically, the container support apparatus 10 of the instant invention essentially comprises a base member 11 arranged as a downwardly directed suction cup, with a support leg 12 fixedly and coaxially mounted to a top surface of the base member 11. A ball and socket mount 13 is formed at an upper terminal end of the support leg 12 and includes a socket 13*a* rotatably mounting a sphere 13*b*. A first "U" shaped container support 14 is mounted coaxially to an outer surface of the socket 13*a*, with the first "U" shaped container support 14 including a plurality of parallel spring-biased first legs 15 that are biased in a parallel relationship relative to one another, with the legs 15 fixedly and orthogonally mounted to a first base plate 16. The first base plate 16 is mounted medially of itself to the socket 13*a*. Rotated 90 degrees relative to the first ¢U" shaped container support 14 is a second "U" shaped container support 17. The second "U" shaped container support 17 includes a plurality of parallel spring-biased second legs 18 that are also biased in a parallel relationship relative to themselves and are orthogonally and fixedly mounted to opposed terminal ends of a second base plate 19 that in turn is mounted medially of itself to the first base plate 16 in an orthogonal orientation thereto. The upper terminal ends of the first legs 15 are medially positioned between a respective first and second semi-cylindrical ring 20 and 21. The rings 20 and 21 are arranged orthogonally relative to the upper terminal ends of opposed first legs 15, wherein the first semi-cylindrical ring 20 includes first and second first ring ends 20*a* and 20*b* respectively, while the second semi-cylindrical ring 21 includes respective first and second second ring ends 21*a* and 21*b*. The first ends 20*a* and 21*a* and the second ends 20*b* and 21*b* are each secured in aligned relationship relative to one another and are biased together by a respective first and second spring 31 and 32. The first and second springs are coiled springs, as illustrated, and with the first ends 20*a* and 21*a* coaxially aligned with opposed terminal ends of the first spring and opposed terminal ends of the second ends 20*b* and 21*b* coaxially mounted to opposed terminal ends of the second spring 32 to bias the first and second semi-cylindrical rings 20 and 21 together in engagement and mounting of a container therewithin.

FIG. 5 illustrates a modified container support apparatus 10*a* that further includes a support suction cup 22 mounted at an intersection of the first and second "U" shaped container supports 14 and 17. The support suction cup 22 is directed upwardly to enhance securement of a container directed within the first and second "U" shaped container supports 14 and 17. Further, a mounting spring 28 is mounted at an upper terminal end of the support leg 12 between the support leg 12 and a bottom surface of the intersection between the first and second "U" shaped container supports 14 and 17 to permit biasing of the container supports in a vertical orientation as illustrated, but permit pivotment about the support leg 12.

FIG. 6 provides for a further modified container support apparatus 10*b* that includes a utensil holder 23. The utensil holder 23 includes a utensil support sleeve 24 mounted fixedly to and adjacent a semi-cylindrical lid support 25 that includes a semi-cylindrical trough 25*a* for reception of a cylindrical container lid 30 therewithin, while the sleeve 24 receives a shank portion of a spoon 29 therewithin for mounting the spoon and container lid relative to a container utilized in a feeding event. The foot support 25 includes a spacer rod 27 orthogonally mounted to a planar rear wall of the lid support 25, with the spacer rod 27 mounting an elastomeric mounting band 26 at a rear terminal end of the rod spaced and remote from the lid support 25. The elastomeric band 26 permits vertical positioning of the utensil holder 23, as desired, along a length defined by the support leg 12.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container support apparatus comprising, in combination, an elongate, longitudinally aligned support leg, the support leg includes a lower terminal end and an upper terminal end, the lower terminal end fixedly mounting a suction cup member, with the support leg coaxially aligned to the suction cup member, and the upper terminal end including a pivot connection, the pivot connection mounting support means thereon, with the support means arranged for securement of a container therewithin, and wherein the support means includes a first "U" shaped container support, with the first "U" shaped container support including a plurality of parallel spring-biased first legs that are biased relative to one another, and the first legs mounted to a first base plate, and a second "U" shaped container support, with the second "U" shaped container support including a plurality of parallel spring-biased second legs, the spring-biased second legs biased in a parallel orientation relative to one another, and the second legs orthogonally mounted to a second base plate, the second base plate orthogonally oriented relative to the first base plate and mounted medially thereof, with the first base plate and second base plate bisecting one another, and the first base plate and the second base plate secured together at an intersection, and the intersection mounted to the pivot connection, and wherein each first leg of the spring-biased legs mounts a semi-cylindrical ring at an upper terinal end of each first spring-biased leg, with each ring orthogonally mounted to each upper terminal end of each spring-biased leg, and each ring including an opposed first and second temrinal end, and the first terminal end of each ring in alignment and the second terminal end of each ring in alignment relative to one another, and a turn spring mounted to each of the first temrinal ends and a further turn spring mounted to each of the second terminal ends to bias the first and second termianl ends together.

2. An apparatus as set forth in claim 1 further including a support suction cup mounted to the intersection of the first and second "U" shaped container supports, the support suction cup directed upwardly from the intersection.

3. An apparatus as set forth in claim 2 wherein the pivot connection includes a mounting spring, the mounting spring including a mounting spring top end and a mounting spring bottom end, the mounting spring top end mounted to the intersection of the first and second "U" shaped supports at a bottom surface thereof, and the mounting spring bottom end mounted to the support leg.

4. An apparatus as set forth in claim 3 further including a utensil holder adjustably mounted along the support leg.

5. An apparatus as set forth in claim 4 wherein the utensil holder includes a sleeve mounted adjacent to a semi-cylindrical lid support, the semi-cylindrical lid support defining semi-cylindrical trough, and a rear surface of the semi-cylindrical lid support orthogonally and fixedly having secured thereto a spacer rod, wherein the spacer rod includes an elastomeric mounting band mounted to the spacer rod, with the spacer rod diametrically aligned with the mounting band and secured thereto remote from the semi-cylindrical lid support, and the elastomeric mounting band secured about the support leg permitting axial adjustment of the mounting band along the support leg.

* * * * *